US006148987A

United States Patent [19]

Bernier et al.

[11] Patent Number: 6,148,987

[45] **Date of Patent: *Nov. 21, 2000**

[54] COIN IDENTIFICATION APPARATUS

[75] Inventors: Donald R. Bernier, Rochester; Stephen G. Fraser, Troy; Richard O. Juengel, Romeo, all of Mich.

[73] Assignee: Compunetics, Inc., Troy, Mich.

[ * ] Notice: This patent is subject to a terminal disclaimer.

[21] Appl. No.: 09/137,170

[22] Filed: Aug. 20, 1998

Related U.S. Application Data

[63] Continuation of application No. 08/682,118, Jul. 17, 1996, Pat. No. 5,799,768.

[51] Int. Cl.[7] ..... G07F 7/00

[52] U.S. Cl. ..... 194/213; 194/217

[58] Field of Search ..... 194/205, 210, 194/213, 217, 214

[56] References Cited

U.S. PATENT DOCUMENTS

| | | | |
|---|---|---|---|
| 3,506,103 | 4/1970 | Kuckens et al. . | |
| 3,901,368 | 8/1975 | Klinger . | |
| 3,918,563 | 11/1975 | Schwippert et al. . | |
| 3,918,565 | 11/1975 | Fougere et al. . | |
| 3,933,232 | 1/1976 | Searle et al. . | |
| 3,952,851 | 4/1976 | Fougere et al. . | |
| 4,086,527 | 4/1978 | Cadot | 324/233 |
| 4,108,296 | 8/1978 | Hayashi et al. . | |
| 4,124,110 | 11/1978 | Hovorka . | |
| 4,128,158 | 12/1978 | Dautremont, Jr. . | |
| 4,216,461 | 8/1980 | Werth et al. . | |
| 4,254,857 | 3/1981 | Levasseur et al. . | |
| 4,306,219 | 12/1981 | Main et al. . | |
| 4,353,453 | 10/1982 | Partin et al. . | |
| 4,369,442 | 1/1983 | Werth et al. . | |
| 4,385,684 | 5/1983 | Sugimoto et al. | 194/318 |
| 4,437,557 | 3/1984 | Kolbl et al. | 194/346 |
| 4,446,956 | 5/1984 | Knickerbocker . | |
| 4,460,003 | 7/1984 | Barnes et al. . | |
| 4,538,719 | 9/1985 | Gray et al. . | |
| 4,574,936 | 3/1986 | Klinger | 194/318 |
| 4,625,852 | 12/1986 | Hoormann . | |
| 4,660,705 | 4/1987 | Kai et al. | 194/318 |
| 4,664,244 | 5/1987 | Wright | 194/317 |
| 4,674,618 | 6/1987 | Eglise et al. | 194/210 |
| 4,678,994 | 7/1987 | Davies | 324/236 |
| 4,724,998 | 2/1988 | Long et al. . | |
| 4,739,869 | 4/1988 | Hoormann . | |

(List continued on next page.)

FOREIGN PATENT DOCUMENTS

| | | | |
|---|---|---|---|
| 0609923 | 8/1994 | European Pat. Off. | 194/317 |
| 2-12491 | 1/1990 | Japan | 194/317 |
| 2045498 | 10/1980 | United Kingdom | 194/317 |

OTHER PUBLICATIONS

Ecm 9200 "Electronic Coin Mechanism" brochure, Star Vend Supply Co., Inc., publication date unknown.

"Sho–Rack Electronics" brochure, Kaspar Wire Works, Inc. publication date unknown.

Bellatrix Systems brochure, "How To Make Every Single Copy Count", publication, 1994.

*Primary Examiner*—F. J. Bartuska

*Attorney, Agent, or Firm*—Young & Basile, PC

[57] ABSTRACT

A coin identification apparatus includes a pair of series connected coils driven by an oscillator. Frequency and/or amplitude characteristics of the oscillator output generated by the passage of a distinct token between the pair of coils are compared with prestored characteristics of acceptable tokens. A processor, upon detecting a match between the detected and pre-stored frequency and amplitude characteristics, activates a motor to rotate a coin receptacle to a coin return position discharging the token to the user, simultaneously causes a door latch pin to separate from a door latch allowing opening of the door to permit access to the interior of the enclosure in which the coin identification apparatus is mounted and selects a new total vend value from memory associated with a detected token.

11 Claims, 8 Drawing Sheets

U.S. PATENT DOCUMENTS

| | | | |
|---|---|---|---|
| 4,754,862 | 7/1988 | Rawicz-Szczerba et al. | 194/319 |
| 4,828,097 | 5/1989 | Kresta et al. . | |
| 4,838,405 | 6/1989 | Kimoto | 194/318 |
| 4,845,484 | 7/1989 | Ellsberg . | |
| 4,870,360 | 9/1989 | Collins et al. | 324/235 |
| 4,905,814 | 3/1990 | Parker et al. . | |
| 4,915,206 | 4/1990 | Kresta et al. . | |
| 4,951,800 | 8/1990 | Yoshihara | 194/317 |
| 4,989,715 | 2/1991 | Grünig | 194/317 |
| 5,007,520 | 4/1991 | Harris et al. | 194/317 |
| 5,025,908 | 6/1991 | Ullman et al. . | |
| 5,036,966 | 8/1991 | Kaspar et al. | 194/217 |
| 5,040,657 | 8/1991 | Gunn et al. | 194/317 |
| 5,067,604 | 11/1991 | Metcalf | 194/203 |
| 5,143,251 | 9/1992 | Kahanek et al. . | |
| 5,154,272 | 10/1992 | Nishiumi et al. | 194/318 |
| 5,167,313 | 12/1992 | Dobbins et al. | 194/317 |
| 5,191,957 | 3/1993 | Hayes | 194/318 |
| 5,213,233 | 5/1993 | Schmitt . | |
| 5,216,234 | 6/1993 | Bell | 194/214 X |
| 5,216,907 | 6/1993 | Ullmann . | |
| 5,248,023 | 9/1993 | Vidondo | 194/317 |
| 5,263,566 | 11/1993 | Nara et al. | 194/318 |
| 5,293,979 | 3/1994 | Leuasseur | 194/317 |
| 5,293,980 | 3/1994 | Parker | 194/317 |
| 5,316,119 | 5/1994 | Sugimoto et al. | 194/318 |
| 5,318,195 | 6/1994 | Kahanek et al. . | |
| 5,337,253 | 8/1994 | Berkovsky . | |
| 5,351,798 | 10/1994 | Hayes | 194/318 |
| 5,351,799 | 10/1994 | Ibarrola | 194/346 |
| 5,353,906 | 10/1994 | Takamisawa et al. | 194/319 |
| 5,360,093 | 11/1994 | Baer | 194/206 |
| 5,377,808 | 1/1995 | Baer et al. | 194/216 |
| 5,381,880 | 1/1995 | Pearson | 194/217 |
| 5,397,019 | 3/1995 | Schmitt | 221/130 |
| 5,415,264 | 5/1995 | Menoud | 194/217 |
| 5,431,300 | 7/1995 | Kahanek et al. | 221/151 |
| 5,433,310 | 7/1995 | Bell | 194/318 |
| 5,458,225 | 10/1995 | Iwamoto et al. | 194/318 |

COIN IDENTIFICATION APPARATUS

CROSS REFERENCE TO CO-PENDING APPLICATION

This application is a continuation of U.S. patent application Ser. No. 08/682,118, filed Jul. 17, 1996, now U.S. Pat. No. 5,799,768, the entire contents of which are incorporated herein by reference.

BACKGROUND OF THE INVENTION

1. Field of the Invention

The present invention relates to apparatus and methods for determining the validity and denomination of tokens or coins for the operation of a device, such as a newspaper vending machine and, more specifically, to battery operated coin recognition apparatus for newspaper vending machines.

2. Description of the Prior Art

Tokens and coins are generally made in distinct sizes for different denominations and may also be made in distinct materials or combinations of materials. Such tokens or coins may be differentiated in a coin-feed apparatus typically used in an automatic vending machine based on the electromagnetic properties of the tokens or coins.

It is known to insert coins through a coin detection device having an electromagnetic field generated by a coil or coils driven by a high frequency oscillator. Variations in the electromagnetic field caused by the metal or alloy content of each coin passing through the field are detected by sensing the frequency and/or amplitude change of the oscillating electrical signal passing through the coils. Such sensed frequency and/or amplitude values are compared with prestored frequency and amplitude data to determine if the sensed characteristics of a coin are within a predetermined limit indicative of an acceptable coin. If a match occurs, the coin is acceptable.

The main requirement for in all such coin discrimination apparatus is a high accuracy in detecting acceptable coins and immediately detecting and rejecting invalid coins, such as slugs. Such unacceptable coins, which typically are washers or round metal discs, could also be coins from a different country, or coins in a given country but of an unacceptable denomination, such as pennies, nickels, etc. Thus, there is a continuing need to improve the accuracy of coin detection devices in identifying only acceptable or valid coins while promptly rejecting invalid coins or slugs.

Substantially all prior art single article or newspaper vending machines employ a manual coin button to return inserted coins to the coin return receptacle. Such manual coin return buttons are subject to frequent vandalism and damage. In addition, since the movable coin return button typically extends outward from the face plate of the vending machine, the return button is prone to freezing during inclement weather. Thus, it would be desirable to provide a coin identification or recognition apparatus for an article vending machine which eliminates the need for a manually operated, externally movably mounted coin return button.

Another problem which is common to all newspaper vending machines is the need for the operator or carrier to change the total vend price of the newspaper between at least daily and Sunday prices and sometimes to a special edition price. This requires the carrier to open the vending enclosure door and manually adjust a price change mechanism. Recently, electronic keys or scanners have been used to implement a vending price change. It is not uncommon for a carrier to utilize a slug or actual coins to open the vending enclosure door to implement a price change. Multiple coins or slugs are typically required for each opening operation and are retained in the coin receptacle within the enclosure. The slugs must then be subsequently manually separated from the actual coins. Since a carrier may typically service hundreds of vending machines, a considerable number of slugs are required to implement each price change. Even if actual coins are used to open the enclosure, a considerable amount of cash must be employed by the carrier for each price change, which coins do not represent newspaper sales.

From a manufacturing standpoint, it is also desirable that a coin identification apparatus be designed to accept coins of different countries so that the coin identification apparatus may be used throughout the world, be able to accept coins from multiple countries at the same time as acceptable or valid coins, and to discriminate between each set of country coins as well as to accommodate the varying denominations of each set of coins.

Another problem associated with prior coin identification devices is the variations in the characteristics of the oscillating signal applied to the detecting coils due to temperature changes. Unless temperatures variations are specifically addressed, a coin identification device will not be able to accurately differentiate between acceptable and unacceptable coin over a wide range of ambient temperatures.

Further, a common application for coin identification devices is in remote, stand-alone vending machines, such as newspaper boxes. Such newspaper boxes are typically located outdoors frequently at a considerable distance from any source of electrical power. Thus, such devices must be provided with an internal power supply for powering the electronic circuitry employed in the coin identification device. This introduces another variable in that battery voltage will obviously decrease over time as the batteries weaken. This could make it difficult to accurately discriminate between acceptable and unacceptable coins at low power levels.

In most previously devised newspaper vending machines, the coins inserted into the coin recognition device are typically held in a stack until the correct total amount of coins have been inserted at which time the coin stack is released for deposit in an internal coin storage box. At any time upon depression of the coin return button, the coin stack is shunted to the coin return receptacle. Since different newspaper companies favor different locations for the coin return slot and the internal coin storage box, previously devised coin recognition apparatus typically employed in newspaper vending machines have been constructed in several different configurations which provide for the location of the coin return slot on either the left or right hand side of the coin insertion slot. Thus, it would be desirable to provide a coin recognition device for use in an article or newspaper vending machine which permits easy adaptation to various coin return slot positions without extensive modification to the coin recognition device.

Most newspaper vending machines have previously utilized electromechanical solenoids to release a latch pin from the enclosure door latch to enable the enclosure door to be opened for removal of a newspaper from the enclosure. Such solenoids consume considerable power thereby reducing the life of the internal batteries employed in modern electronic based coin recognition devices. Also, such solenoids place a significant amount of force on the door latch which must be overcome when the door latch is moved to the closed position. If a customer closes the door extremely gently the force to set the latch may be insufficient such that the door will remain slightly open allowing the next customer to simply open the door without inserting any coins. Thus, it would be desirable to provide an improved door latch operating mechanism for a coin recognition device which overcomes the aforementioned problems with previously devised coin recognition devices utilized in newspaper vending machines.

It would also be desirable to provide a coin identification apparatus that overcomes the aforementioned problems encountered with previously devised coin identification apparatus. It would also be desirable to provide a coin identification apparatus which is easily programmable and can accurately distinguish acceptable coins from many different countries. It would also be desirable to provide a coin identification apparatus which automatically compensates for temperature and battery voltage variations.

SUMMARY OF THE INVENTION

The present invention is a coin identification apparatus which discriminates and identifies acceptable coins from unacceptable coins or slugs inserted into the apparatus.

The coin identification apparatus includes a coin receiver having a coin passage with a coin entrance and a coin discharge outlet; a pair of coils disposed on opposite sides of the coin passage, the coils formed as a plurality of planar turns arranged in spaced, straight sections and arcuate end sections, the straight sections extending substantially across the entire width of the coin passage; means for applying alternating electric current to the pair of coils; means for detecting a change in the frequency and amplitude of the current in the coils and a coin passes through the pair of coils; means for storing peak frequency and peak amplitude values associated with a valid coin; means for comparing stored peak frequency and amplitude values with the detected frequency and amplitude values of each coin passing through the pair of coils; and means for generating an output when the detected frequency and amplitude values of a coin passing through the pair of coils match one of the plurality of stored frequency and amplitude value pairs.

The coin identification apparatus of the present invention provides an extremely accurate coin identification to enable acceptable coins to be discriminated from unacceptable coins. The coin identification apparatus is capable of detecting maximum peak frequency and minimum peak amplitude changes in the output of an oscillator due to the passage of a coin through a pair of generally planar, series connected, elongated coils. The elongated form of the coils ensures that any diameter coin passing through coils is completely encompassed within the coils and passes through the full width of the coils.

The present apparatus also provides unique temperature and power supply voltage compensation to the prestored frequency and amplitude values to provide compensation for temperature and voltage variations during use of the coin identification apparatus.

The present apparatus also provides an automatic coin return/coin storage feature which eliminates the need for a manual coin return button. Upon detecting any invalid coin or at the expiration of a preset time period between successive coin insertions, the coin receptacle is automatically rotated to the coin return position to discharge all previously inserted coins into the coin return receptacle. By eliminating the manual coin return pushbutton used on most previously devised vending machines, a significant reduction in damage and vandalism encountered with previously devised vending machines can be achieved. Further, any freezing or other jamming of the manual coin return button is eliminated, thereby enhancing the long term reliability and useful life of the present apparatus in all external weather conditions.

The present apparatus also has a unique door latch construction which automatically causes release of the door latch enabling opening of the closure door simultaneous with movement of the coin receptacle to the coin storage position when a total coin vend amount has been properly inserted into the apparatus. The door latch has a minimal latch force such that any movement of the enclosure door to the closed position is sufficient to fully engage the door latch with the latch pin to latch the door in the closed position. The use of a motor driven latch pin mechanism also reduces electrical power requirements thereby increasing the useful life of the on-board battery(s).

The present apparatus is also formed of a reduced number of total components and a minimal number of moving components. This contributes to a long term useful life, enhanced reliability, and a quick repair time in the event of damage or repair.

The present apparatus also has a unique total vend price change procedure which eliminates the previous use of tokens or coins by a newspaper carrier to change the total vend price of a newspaper vending machine between daily and Sunday prices. Each valid coin is assigned a unit value constituting a discrete number of units. The unit values of all valid coins received in the coin receptacle are totalized and compared with a preset total vend price which also has a total unit value. One and preferably two special tokens having unique alloy content to provide discrete peak frequency and peak amplitude recognition features are assigned unique unit values. Insertion and recognition of either of these tokens by the apparatus will cause the processor in the apparatus to change the total vend unit value to a different prestored amount corresponding to the token. This enables a carrier to automatically change the total vend price of the newspaper vending machine from daily to Sunday or from Sunday to daily prices by merely inserting a special token. As soon as the price change has been implemented, the processor activates the motor to rotate the coin receptacle to the coin return position thereby returning the token to the carrier. The carrier thus need only carry one token at a minimum to implement each vend price change.

The unique rotatable coin return receptacle or basket also simplifies the construction of coin identification devices utilized in newspaper vending machines since the coin receptacle is designed for rotation about an axis extending perpendicularly from a face plate containing the coin insertion slot from a center position aligned with the discharge outlet of the coin passage and at least one of two opposite positions defined as the coin return position and a coin storage position. In a newspaper vending machine which has the positions of the coin return receptacle and the internal coin storage box reversed from other vending machines, the processor need only be reprogrammed to rotate the coin receptacle in the appropriate direction to the coin return position or to the coin storage position. This eliminates any redesign of the enclosure or mechanical operation of the coin identification apparatus to suit different vending machine configurations.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENT

Figure 1:
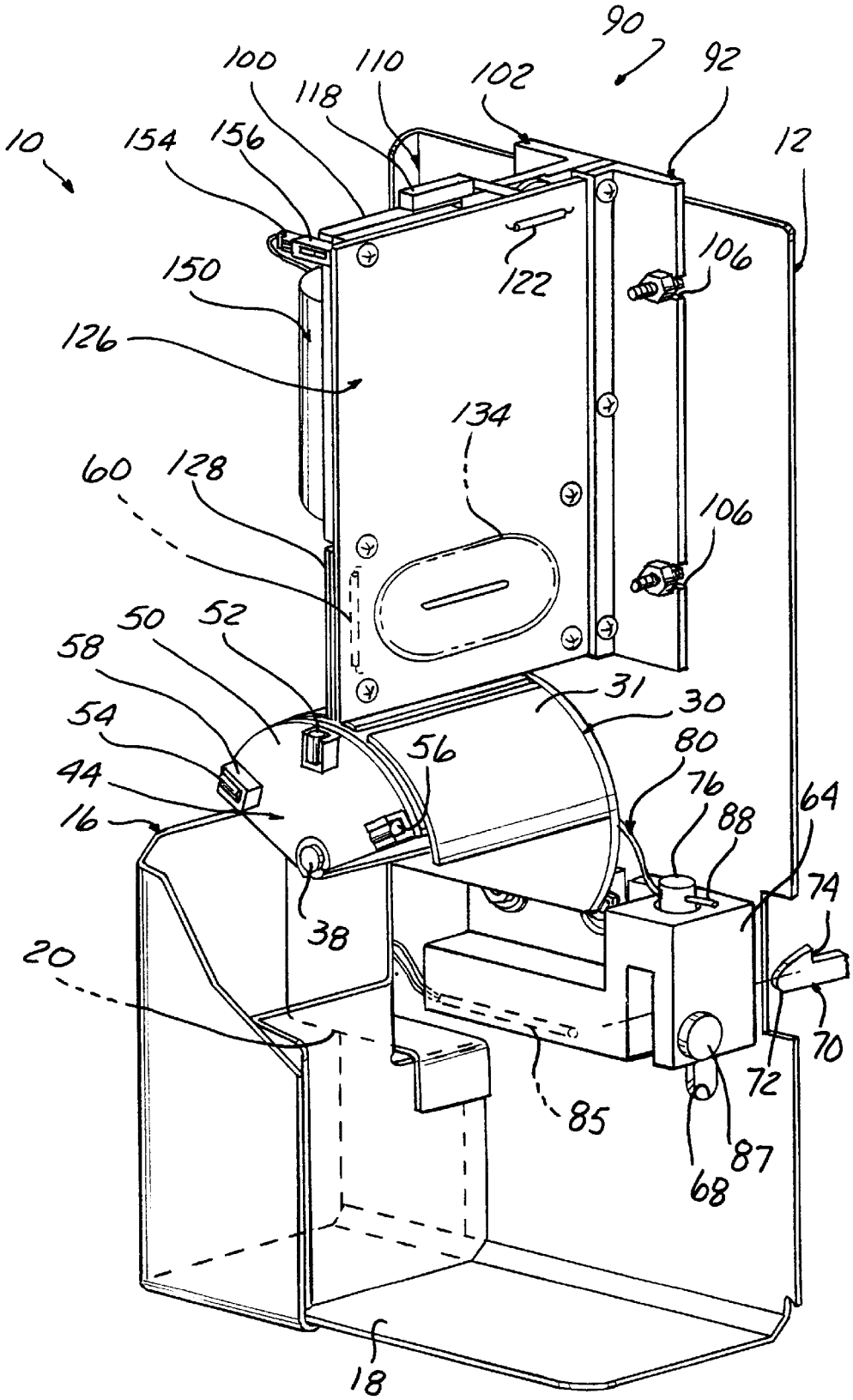
FIG. 1 is a rear perspective view of a coin identification apparatus constructed in accordance with the teachings of the present invention.

Referring now to the drawing, and to FIGS. 1–7 in particular, there is depicted a coin identification apparatus 10 which identifies and discriminates between acceptable and unacceptable coins or tokens inserted into the apparatus 10.

Figure 4:
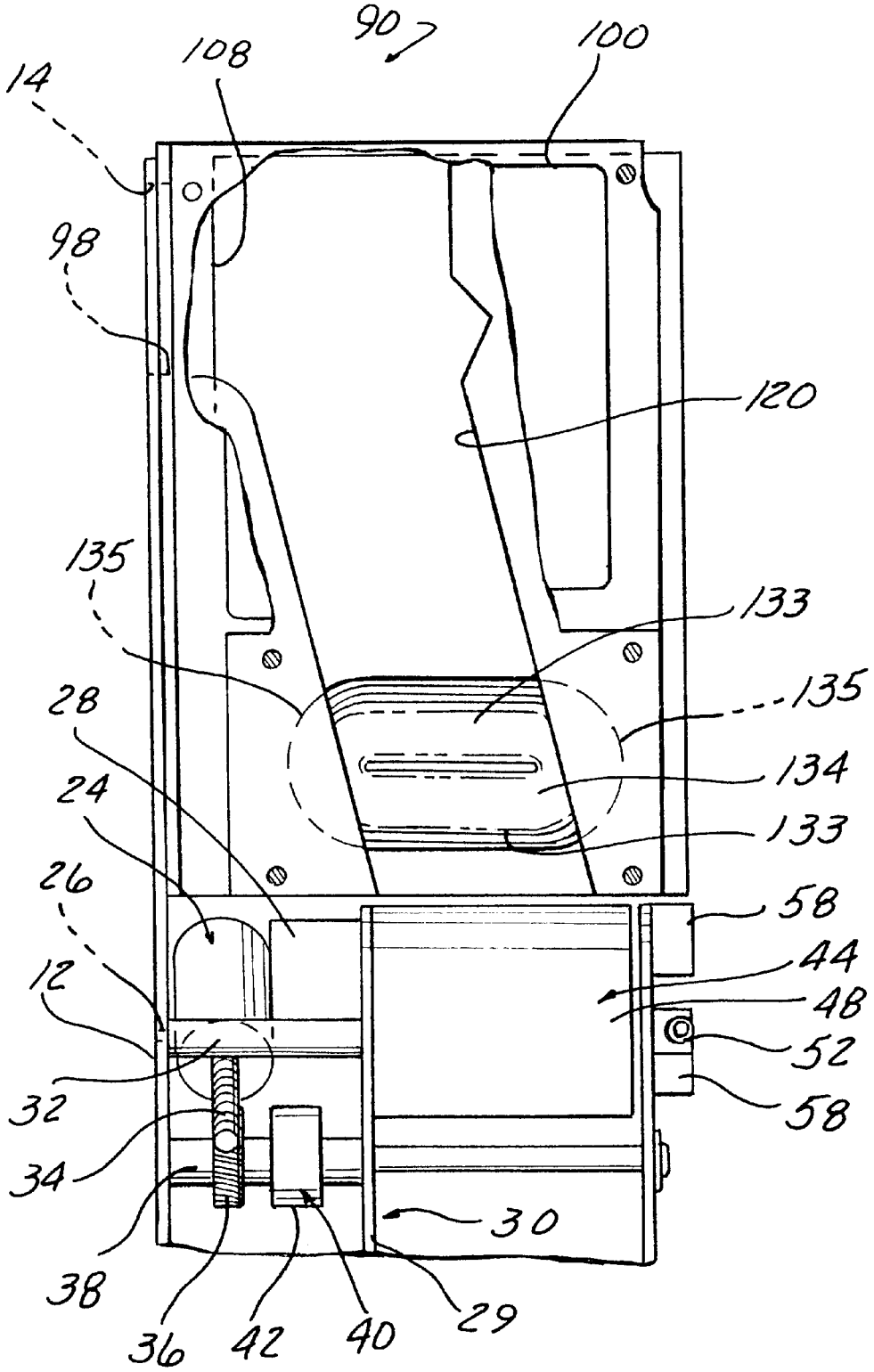
FIG. 4 is a partially broken away, left side elevational view of the coin receiver shown in FIG. 3.

The coin identification apparatus 10 is suited for mounting in an enclosure, not shown, typically employed in an automatic vending machine, such as, by example only, a newspaper vending machine. A generally planar face plate 12 provides a mounting surface for the various components of the coin identification apparatus 10 as described hereafter. The face plate 12, as shown in FIG. 4 has a coin receiving slot 14 formed therethrough. The slot 14 has a length and width to receive the maximum diameter and thickness coin acceptable to the coin identification apparatus 10.

As shown in FIG. 1, a coin return receptacle generally in the form of a three-sided, open-ended enclosure 16 is located on the back surface of the face plate 12 on a base plate or base extension 18 which extends perpendicularly from a bottom edge of the face plate 12. An aperture 20 is formed in a lower portion of the face plate 12 and opens to the interior of the coin return receptacle 16 to enable coins deposited into the receptacle 16, as described hereafter, to be retrieved by a user.

A motor 24, shown in FIG. 4, is mounted between a slot 26 in the face plate 12 and an opposed recess in a mounting block 28 formed on a shroud 30. The shroud 30 is formed of an arcuate shaped top wall 31 which is connected to a front wall 29. The shroud 30 is supported by a mounting post 32 extending from the back surface of the face plate 12 to the front wall 29.

Figure 6:
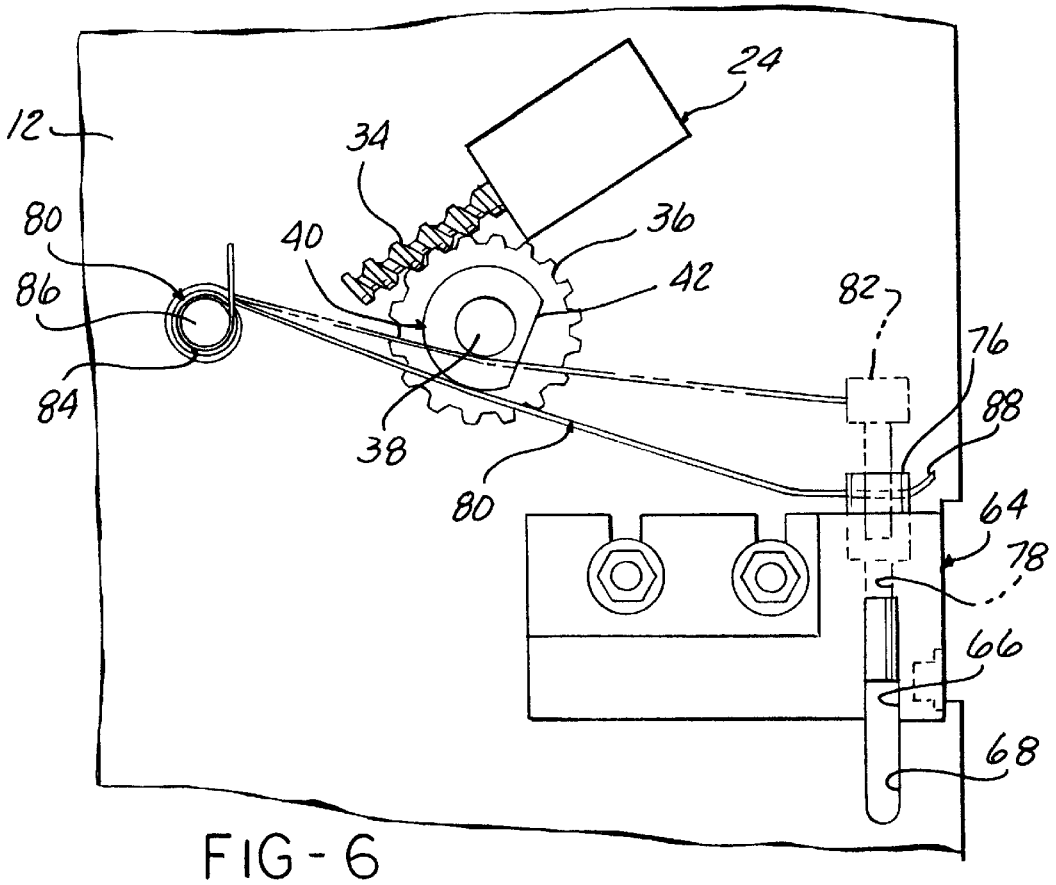
FIG. 6 is a partial, elevational view of the door latch mechanism.

As shown in FIGS. 4 and 6, the motor has a bi-directional, rotatable output shaft with a worm 34 formed at an outer end. The worm 34 threadingly engages a gear 36 fixedly mounted on a shaft 38 rotatably extending generally perpendicularly from the face plate 12. A cam 40 having a generally circular periphery with a flat 42 is also fixedly mounted on the shaft 38 adjacent to the worm gear 36.

A coin escrow or receiving basket denoted generally by reference number 44 is also fixedly mounted on the rotatable shaft 38. The coin basket 44 is formed with first and second angularly disposed side walls 46 and 48 which extend at an obtuse angle from each other radially outward from the shaft 38. An end wall 50 is integrally formed with the side walls 46 and 48 and is spaced from the front wall 29 of the shroud 30.

Figure 2:
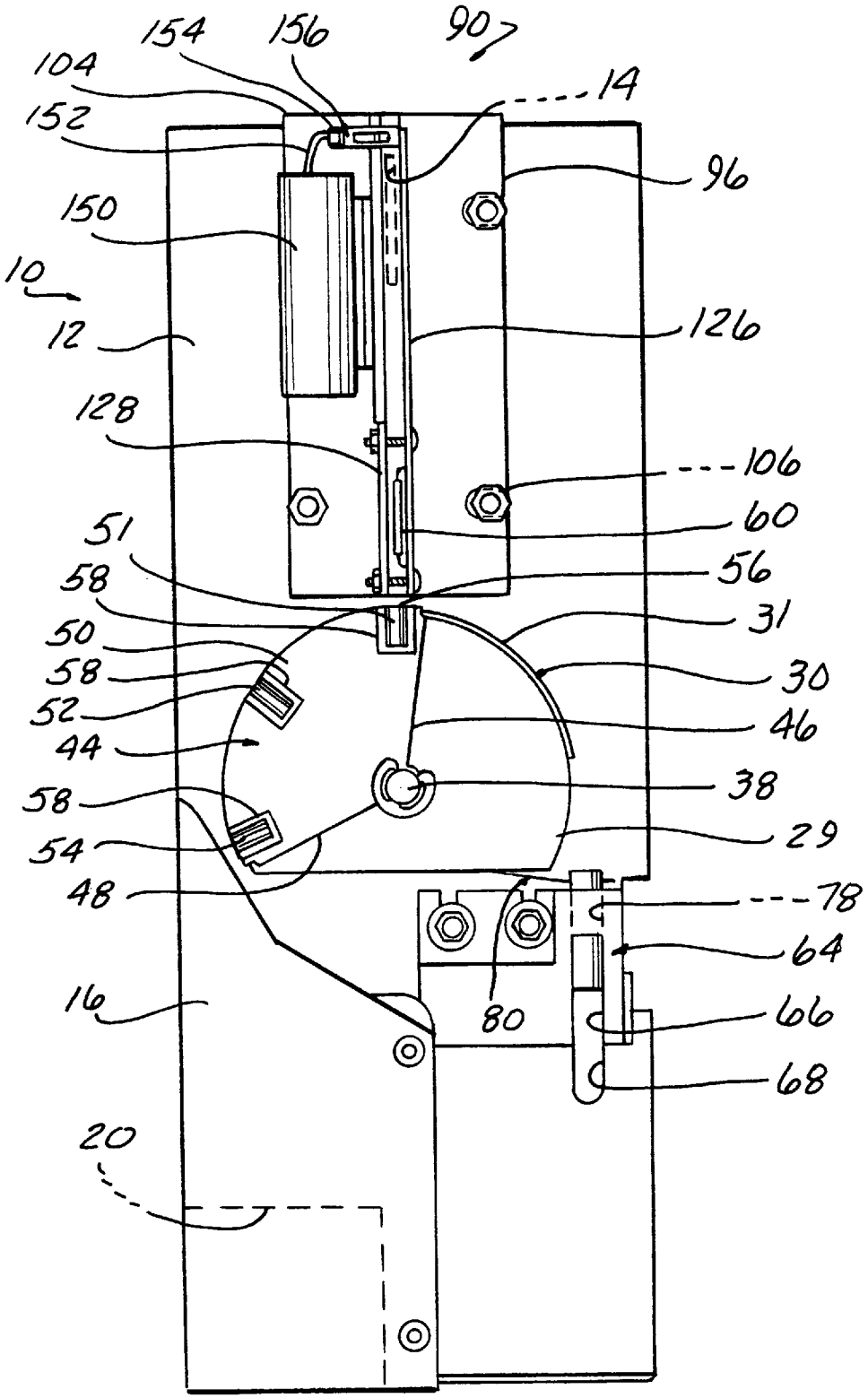
FIG. 2 is a rear elevational view of the coin identification apparatus shown in FIG. 1.

The coin basket 44 is rotatable with rotation of the shaft 38 between three distinct positions, namely, a normal center position directly underneath a coin passage described hereafter, and either one of two rotated positions including a first rotated position shown in FIG. 2 in which side wall 48 of the coin basket 44 is angled downwardly to dispense coins contained within the coin basket 44 into the coin return receptacle 16. The coin basket 44 is also rotatable in an opposite direction to a second position in which the side wall 44 extends angularly downward to dispense coins from the coin basket 44 into a coin storage receptacle, not shown, mountable within the bottom portion of the base plate 18 and face plate 12. The locations of the coin return receptacle and the coin storage or escrow box can be reversed. In this case, the coin basket 44 is rotated opposite from that described above. In this manner, various enclosure configurations are easily accommodated.

Three magnets 52, 54 and 56 are arcuately spaced apart and mounted in individual holders 58 formed on the end wall 50 of the coin basket 44. The magnets 52, 54 and 56 enable the control circuitry described hereafter to rotatably position the coin basket 44 in one of the three above-described positions by interaction of each magnet 52, 54 and 56 with a magnetically responsive switch, such as a reed switch 60 mounted in a coin receiver described hereafter.

As shown in FIGS. 1, 2 and 6, a door latch receiver 64 is mounted on the back surface of the face plate 12. The receiver 64 is in the form of a generally solid block having a through slot 66 which is alignable with an elongated slot 68 formed in the face plate 12.

A magnet 87 is mounted in the door latch receiver 64 on one side of the slot 66. A magnetically responsive switch 85 is mounted in the receiver 64 on the other side of the slot 66 and is positioned to have a contact switch position under influence of the magnet 85.

In an exemplary embodiment, the apparatus 10 is mounted in an enclosure, not shown, containing vend articles, such as newspapers. A closable door on the enclosure has a door latch 70 extending therefrom. The door latch 70 has an angled or curved front end 72 sized to releasibly slide through the slot 68 and the face plate 12 and the slot 66 in the door latch receiver 64. A shoulder 74 is formed in the door latch 70 and is positioned to be releasibly engaged by a latch pin 76 slidably mounted in a bore 78 in the door latch receiver 64. A lower end of the latch pin 76 slides into the slot 66 to engage the shoulder 74 on the latch pin 70 to latch the door latch 70 in a fixed position relative to the coin identification apparatus 10. The latch pin is slid upward, as described hereafter, to enable the door latch 70 and the attached door to be opened to enable a user to remove an article from the surrounding enclosure.

A biasing means 80, preferably in the form of a resilient spring is wrapped in a plurality of turns 84 about a mounting post 86 extending from base plate 12. A first end 86 of the spring 80 extends through a bore formed in an upper portion of the latch pin 76 to control the sliding movement of the latch pin 76 between the latch and unlatched positions.

An intermediate portion of the spring 80 is engaged by the cam 40 as shown in FIG. 6. When the enlarged diameter circular portion of the cam 40 engages the spring 80, as shown in FIG. 6, cam 40 will force the biasing spring downward thereby sliding the latch pin 76 to the latched position. When the motor 24 rotates the cam 40 in a direction to move the coin receptacle or basket 44 to the second position discharging coins to the coin storage receptacle, the flat 42 will be rotated opposite the intermediate portion of the spring 80 thereby enabling the spring 80 to move closer toward the shaft 38 carrying the cam 40. This causes the spring 80 to slide the latch pin 76 upward to the unlatched position.

A coin receiver 90 is mounted on the face plate 12. By example only, the coin receiver 90 is formed of first and second housing parts 92 and 102. The first housing part 92 includes a first leg 94 and a second shorter leg 96 extending generally perpendicular therefrom. A slot 98 is formed in first housing part 92 and is aligned with the slot 14 in the face plate 12. The second leg 96 is joined to a second leg 100 of the second housing part 102 by means of fasteners 98. The second housing part 102 also has a short leg 104 which extends perpendicular from the leg 100 and is generally aligned with the leg 94 of the first housing part 92. Mounting slots 106 are formed in the legs 94 and 104 for receiving fasteners to mount the coin receiver 10 to the face plate 12.

Mounting slots 106 are formed in the first legs 94 and 104 of first and second housing parts 92 and 102 and receive suitable fasteners to mount the coin receiver 90 to the back surface of the face plate 12.

Figure 3:
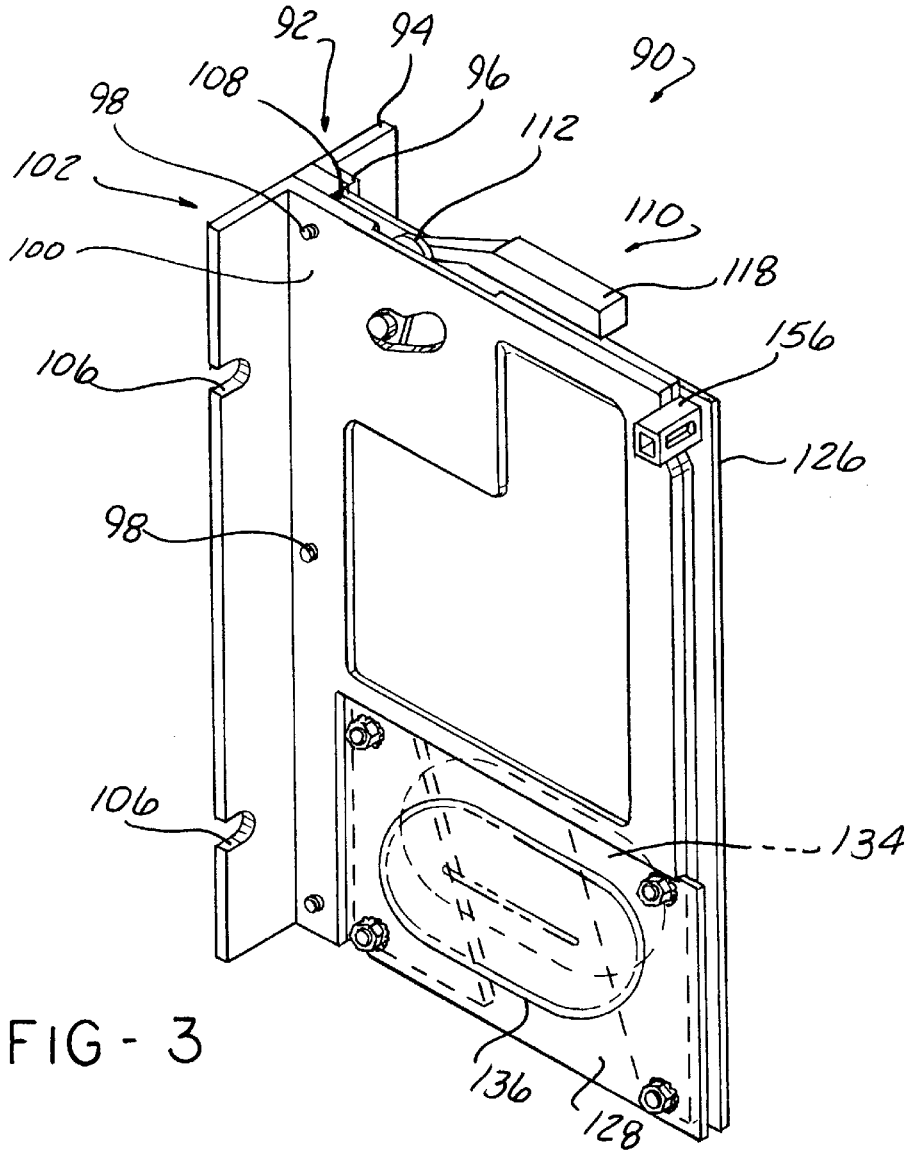
FIG. 3 is a left side rear perspective view of the coin receiver employed in the coin identification apparatus shown in FIGS. 1 and 2.
Figure 5:
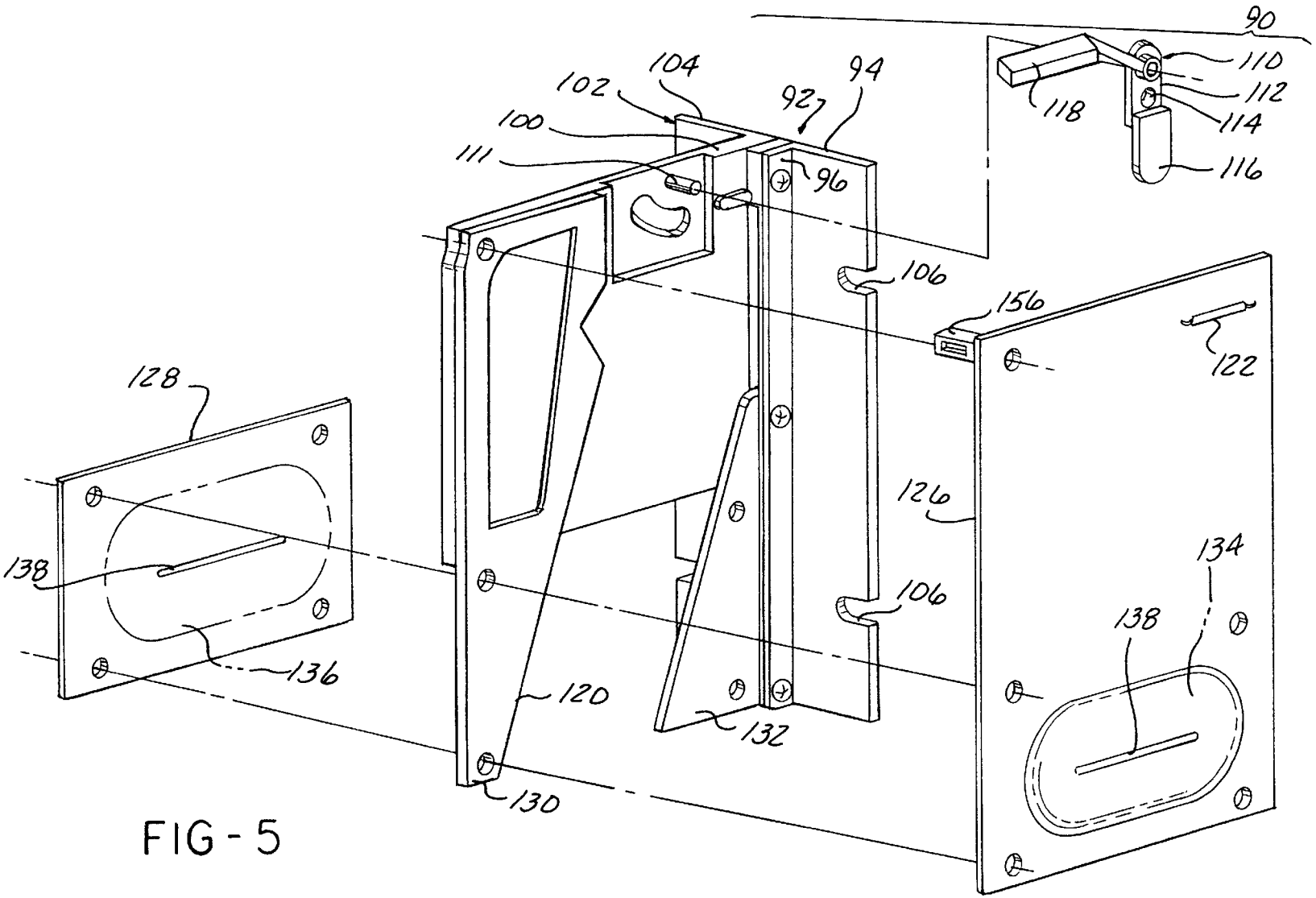
FIG. 5 is an exploded, rear perspective view of the right-hand side of the coin receiver.

As shown in FIGS. 3, 4 and 5, a recess 108 is formed in an upper portion of the leg 100 of the second housing part 102. A pivot pin 111, shown in FIG. 5, is mounted on the leg 100 and extends into the recess 108 for rotatably supporting a coin detect arm 110. The arm 110 has an intermediate portion 112 pivotally mountable on the pivot pin 111. A magnet 114 is mounted in a bore in the intermediate portion 112. A lower portion 116 extends from the intermediate portion 112 and is normally disposed in the travel path of a coin inserted through the coin slots 14 and 98 so as to cause the arm 110 to pivot about the pin 110. A counterweight 118 extends from the portion 112 oppositely from the lower end 116 to normally bias the arm 110 to a first coin detection position.

The coin passage denoted by reference number 120 is formed of two spaced walls in the second housing part 102. The walls extend from the slot 98 angularly downward to a lower portion of the leg 100 of the second housing part 102. The spacing between the walls of the coin passage 120 is selected to be slightly larger than the maximum diameter coin or token which will be identified as an acceptable coin or token by the coin identification apparatus 10. The lower end of the coin passage 120 opens into the coin basket 44 as shown in FIGS. 1 and 2 when the coin basket 44 is in the center coin receiving position shown in FIG. 1.

As shown in FIGS. 1–5, a first printed circuit board 126 is mounted on one side of the first leg 100 of the second housing part 102 and extends generally perpendicularly from an abutment with one edge of the leg 96 of the first housing part 102. Suitable mounting fasteners, such as nuts and bolts or screws may be employed to securely mount the first printed circuit board 126 to the second housing part 102.

A sensor 122, such as a reed switch mounted on the first printed circuit board 126 at a position to be activated or have its switchable contact moved under influence with the magnet 114 in the coin detection arm 110 when a coin is inserted through the slots 14 and 98 and strikes and causes the lower end 116 of the coin detection arm 110 to pivot moving the magnet 114 out of proximity with the switch 122. The output from the sensor or switch 122 is an indication that a coin has been inserted through the slots 14 and 98 in the coin receiver 90.

A second, smaller printed circuit board 128 is secured by means of fasteners to a lower end of the first printed circuit board 126. The second printed circuit board 128 and the lower end portion of the first printed circuit board 126 are disposed in engagement with opposite sides of a pair of depending flanges 130 and 132 which extend downward at a lower end portion of the leg 100 of the second housing part 102. Inner facing edges of the flanges 130 and 132 form the coin passageway 120 as shown in FIG. 5.

Two identical coils 134 and 136 are each respectively mounted in the first printed circuit board 126 and the second printed circuit 128. Preferably, the coils 134 and 136 are integrally formed on each printed circuit board 126 and 128. The first and second coils 134 and 136 are connected in series as described hereafter. Each of the first and second coils 134 and 136 has an elongated, generally oval shape formed of a plurality of turns about a small, generally oval shaped open center 138. Each coil, such as coil 134 shown in FIG. 4 has a pair of straight sections 133 on opposite sides of the open center 138 and a pair of arcuate end sections 135.

As shown more clearly in FIG. 4, the length of each coil 134 and 136 is greater than the corresponding height or width of each coil 134 and 136. The length of each coil 134 and 136 is selected so as to be at least as long or longer than the width of the coin passage 120. In this manner, any size coin traveling through the coin passage 120 will have its outer periphery completely passing through the entire width of both of the coils 134 and 136. This increases the accuracy of the coin identification apparatus 10 of the present invention and eliminates any problems encountered when smaller diameter coins pass through the large passageway 120 and may not be directly located over the center of the passageway 120 or the coils 134 and 136.

Electric power to the coin identification circuit mounted on the first and second printed circuit boards 126 and 128 is provided by one or more storage batteries 150 which may be mounted to any suitable location, such as in a suitable holder connected by conductors 152 to an end connector 154 which plugs into a suitable mating connector 156 mounted on the upper end of the first printed circuit board 126. Long life lithium batteries 150 are preferred.

Figure 7:
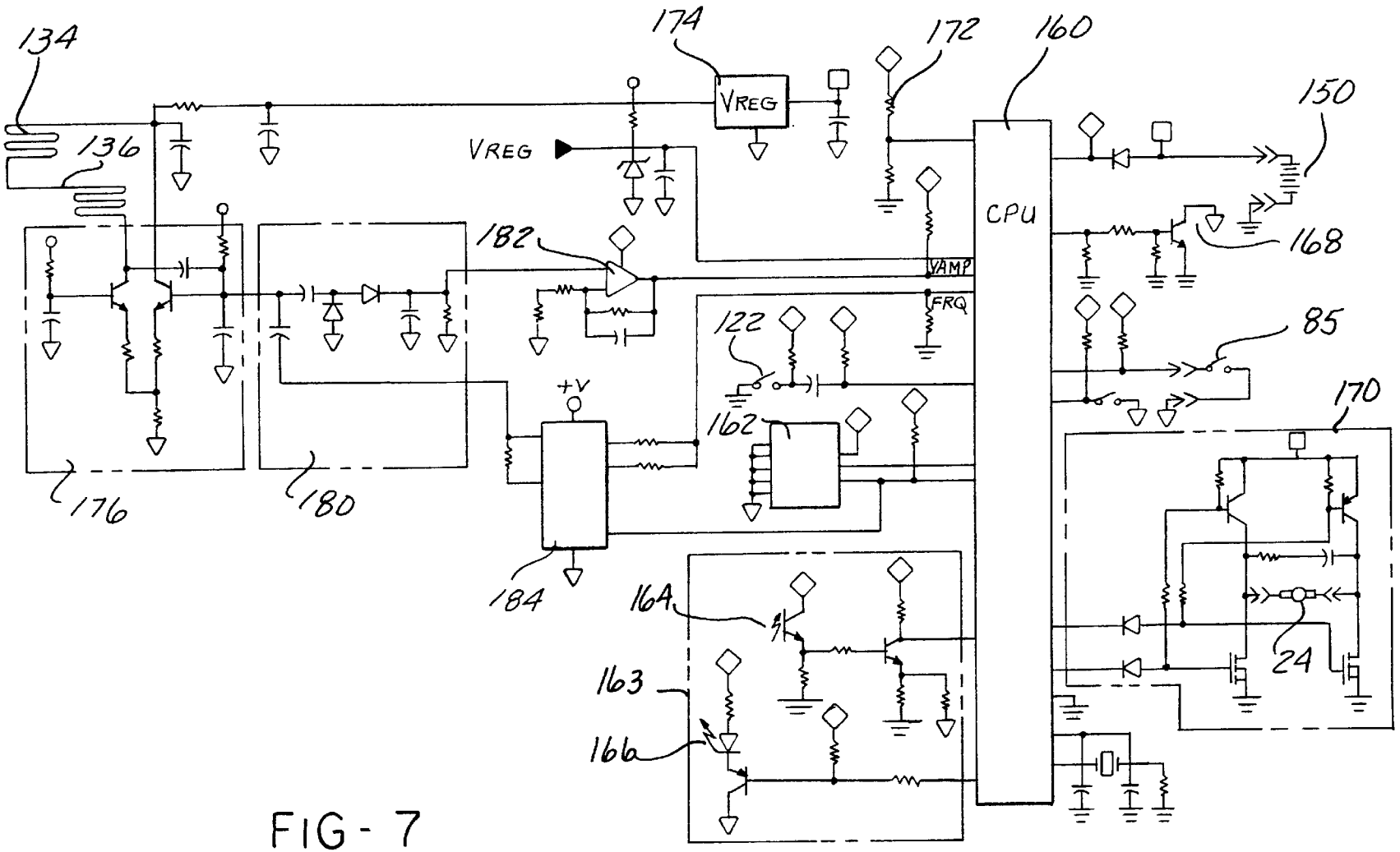
FIG. 7 is a schematic diagram of the circuitry employed in the coin identification apparatus of the present invention.

Referring now to FIG. 7, there is depicted a coin identification circuit including central processing unit or processor 160 mounted on the first printed circuit board 126. By example only, the processor is a processor model No. PIC16C71. The processor includes on-board, analog to digital inputs, each providing an 8-bit digital output between 0 and 255. A memory 162 is disposed in data communication with the processor 160. The memory 162 is any suitable non-volatile memory.

Also connected to the processor 160 inputs and outputs is an optical communication interface 163 formed of a photo transistor 164 and a photo diode 166. The photo transistor 164 and the photo diode 166 are mounted at a set position on the first printed circuit board 126 so as to be disposed adjacent to a corresponding optical interface on a data access device, described hereafter, for data communication therebetween.

Various outputs are provided from the processor 160. A first output is a ground analog transistor 168 which, when in a conducting state, provides a ground connection to the analog portion of the coin identification circuit described hereafter thereby activating the analog circuit. The processor 160 also provides outputs to a bidirectional bridge circuit 170 which provides bidirectional current flow to the motor 24.

Also input to the processor 160 is a temperature sensor 172, such as a thermistor. The temperature sensor 172 provides an output signal representative of the ambient temperature surrounding the coin identification apparatus 10. A voltage regulator 174 provides regulated voltage to an oscillator circuit denoted generally by reference number 176. The oscillator 176 is formed of two transistors which are connected to opposite ends of the series connected pair of first and second coils 134 and 136.

As is conventional, the oscillator introduces a current into the series connected coils 134 and 136 at one frequency. Passage of a coin through the spaced coils 134 and 136 causes variations in the magnetic field between the coils thereby resulting in variations in the frequency and amplitude of the oscillator current.

The output from the oscillator 176 is connected to a sample and hold circuit 180. The sample and hold circuit 180 outputs an analog signal to an op amp 182. The output of the op amp 182 is input to the processor 160 as a signal labeled "VAMP." This is an analog signal representative of the amplitude of the output of the oscillator 176.

The output of the oscillator 176 is also input to a counter 184 which counts the time period of the oscillator output signal to provide an indication of the frequency of the oscillator. The output of the counter 184 is input to the processor 160 as a signal labeled "FRQ."

Also input to the processor 160 is the output of the sensor 122 which detects movement of the coin detect arm 110 upon the introduction of a coin into the coin passage 120. The processor 160 operates in a low power consuming state until a coin is detected by the coin detection arm 110. At the same time, an output from the sensor 122 causes the processor 160 to recalibrate the oscillator 176 for existing ambient conditions.

When the door latch 70 is separated from the coin receiver 64, the magnet 87 will cause switchable contact in the sensor 85 to switch positions, thereby providing an input signal to the processor 160 that the door latch 70 is spaced from the door latch receiver 64. Alternately, when the door latch 70 is latched in the door latch receiver 64, the door latch 70 will break the magnetic coupling between the magnet 87 and the switch 85 thereby causing the switchable contact of the switch 85 to switch positions which provides a signal indicating that the door latch 70 is in a latched position.

Figure 8:
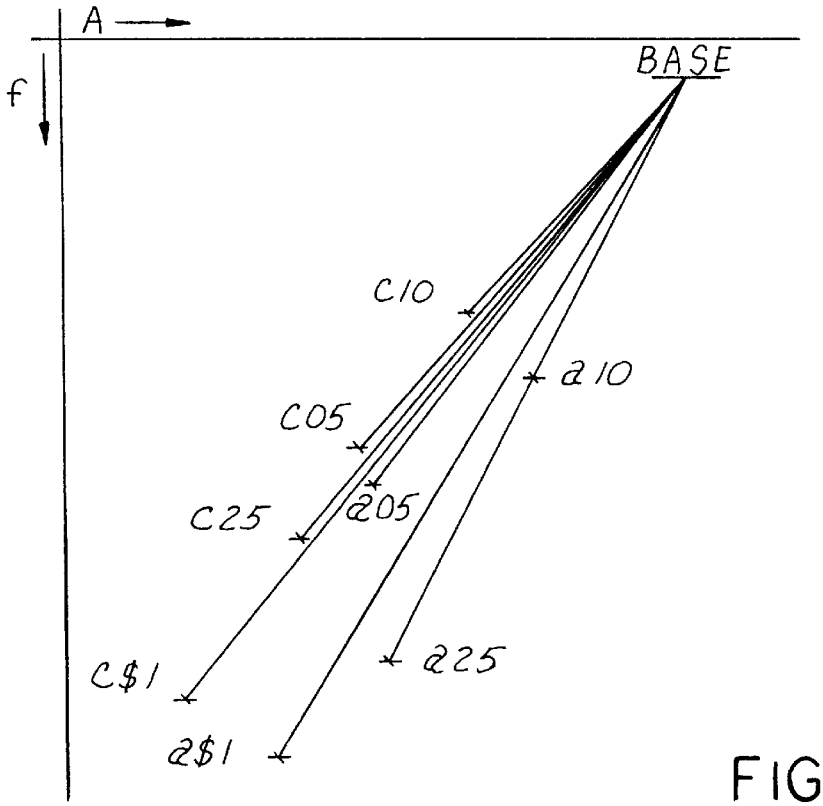
FIG. 8 is a draft depicting the prestored, acceptable frequency and amplitude peak values used by the circuit shown in FIG. 7.

Before describing the operation of the coin identification apparatus 10 of the present invention, a brief description of the coin identification features of the coin identification apparatus 10 will first be described with reference to FIG. 8. FIG. 8 is a graphic representation of the various peak frequency and peak amplitude values stored in the memory 162 and compared by the processor 160 with each coin passing through the coin passage 120. By example only, up to 16 separate coin frequency and coin amplitude combinations may be stored in the memory 162. For clarity, only eight unique coin frequency and amplitude peak value pairs are shown in FIG. 8. The labels "a05", "a10", "a25" and "a$1" respectively represent American nickel, dime, quarter, and dollar coins. Similarly, the labels "c05", "c10", "c25" and "c$1" respectively represent Canadian nickel, dime, quarter and dollar coin. As described hereafter, the maximum peak frequency of each coin is learned by the processor 160 and stored in the memory 162. Each maximum peak frequency value is coupled to a minimum peak amplitude change or value for each of the coins. The minimum peak amplitude values are also stored in the memory 162.

As shown in FIG. 8, each distinct denomination coin of a single country set of coins, as well as coins in other country sets of coins, have a unique frequency-amplitude value which provides a means of discriminating between each discrete coin. In order to allow for minor variations typically encountered with each coin due to variations in material content of each coin, etc., the frequency-amplitude value stored in the memory 162 for each discrete coin denomination is provided with a window of values, such as ±6 amplitude and ±3 frequency. It should be noted that the scale shown in FIG. 8 represents digital values between 0 and 255 as generated by the analog to digital circuitry in the processor 160.

The frequency-amplitude values or signature for each discrete coin is modified by the control program executed by the processor 160 to compensate for variations between the current battery voltage level as detected by the processor 160 and variations in the ambient temperature as detected by the temperature sensor 172 from base battery voltage and temperature values recorded at the time of coin learning or signature. The processor 160, upon detecting variations in the ambient temperature or a decrease in the battery 150 voltage from such base values will essentially proportionally alter the frequency and amplitude values or signature for each valid coin.

Figure 9:
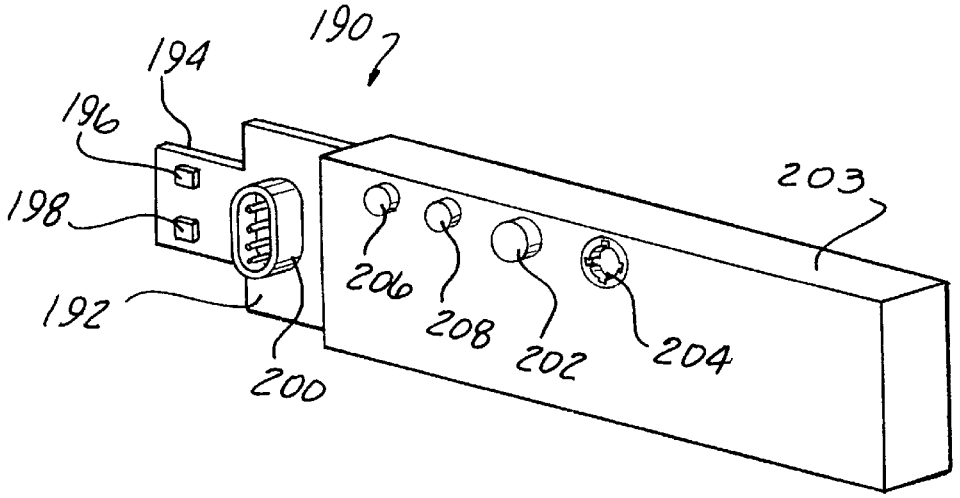
FIG. 9 is a perspective view of a data access device used with the win identification apparatus of the present invention.

As is conventional, the control program executed by the processor 160 is stored in the memory 162. Various input values as well as output data are programmed into the memory 162 or read from the memory 162 via a hand-held data access device 190 shown in FIG. 9. The data access device 190 includes an elongated printed circuit board 192 having a stepped-down end 194 sized to be inserted through the slots 14 and 98 and disposed adjacent to a predetermined portion of the first printed circuit board 126. A microprocessor and memory are mounted on the printed circuit board 192 and execute a control program to provide bi-directional data communication with the processor 160 when the data access device 190 is coupled in data communication with the processor 160 as described hereafter.

A photo diode 196 and a photo transistor 198 are mounted on the end 194 of the printed circuit board 192 and are disposed in a position to be in data communication with the photo transistor 164 and the photo diode 166 on the first printed circuit board 126 of the apparatus 10. This enables data communication, in any format, between the processor 160 and processor on the printed circuit board 192 in the data access device 190. A conventional plug-in connector 200 mounted on the printed circuit board 192 provides a connection to an external central processor, not shown, for programming of the processor in the data access device 190 as well as to read output values from the memory.

An "on/off" switch 202 is mounted on a housing 203 containing the printed circuit board 192. The "on/off" switch 202 provides activation of the data access device 190. A multi-position selector switch 204 is also mounted on the housing 203 and provides keyed switching between a plurality of position enabling different programming or operation functions to be implemented by the data access device 190. For example, in one position of the selector switch 204, a user may be able to program changes in unit price of the articles to be dispensed from the machine containing the coin identification apparatus 10. In another position of the selector switch 204, a user may be able to perform the same unit price change as well as to obtain total currency contained within the coin identification apparatus 10, zero out the currency total upon removing all currency from the apparatus 10, etc.

A pair of lights, such as light emitting diodes 206 and 208 are also mounted on the housing 203 to provide indications of various functions. For example, light 206 will be activated by the central processor and flash at a predetermined rate when the amount of currency contained within the coin identification apparatus 10 exceeds a preset amount. The second light 208, which may be red in color, will be activated and flashed by the central processor when the battery voltage in the coin identification apparatus 10 is detected as being below a preset minimum. Other functions may also be provided by the light 206 and 208 by various flashing rates, etc.

With, the data access device 190 removed from the coin identification apparatus 10, a plurality of identical denomination coin, such as four quarters, nickels, dimes, or dollar coins are then sequentially inserted into the coin identification apparatus 10, which has been placed into a learn mode via the data access device 190. The processor 160 will average the maximum peak frequency and minimum peak amplitude change for each of the four coins to generate an average frequency and amplitude value for a particular denomination coin. These frequency and amplitude values for each acceptable coin are then stored in the memory 162 and form a signature representative of a particular coin, such as an American nickel, dime, quarter or dollar coin as shown in FIG. 8. A second set of acceptable country coins, such as Canadian coins, may also then be programmed into the memory 162 in the same fashion.

At each coin learning operation, the processor 160 senses and stores the battery voltage level and the ambient temperature. These values become base values for each discrete coin and are sized by the processor 160 to vary in the coin signature when variations in the battery voltage and the ambient temperature are later detected.

Immediately prior to or after each coin learning sequence, the data access device 190 provides input data which is stored by the processor 160 in the memory 162 as to the denomination of each validated or learned coin. A unique currency denomination characteristic is utilized in the present invention in that each valid coin is assigned a discrete number of units. Thus, for example, an American quarter will carry a denomination of 25 units, an American dime will be 10 units, and an American dollar coin will be 100 units.

Any foreign country currency can also be used as valid coinage for the apparatus 10 by merely assigning a unit value to the currency and learning the frequency and amplitude of such coins. For example, a Canadian quarter could have 18 units, a Canadian dime 7 units, and a Canadian dollar coin 73 units. This takes into account currency exchange rates thereby insuring that the proper total coin amount is inserted into the apparatus 10 for each vend article.

In addition, the use of unit coin values enables special coins or tokens to also be accepted as valid coin. For example, due to the significantly higher $2 to $4 cost of Sunday newspapers as compared to daily newspapers, a person wishing to purchase a Sunday paper would have to carry a considerable amount of coins, such as quarters or dollar coins, if available, to purchase a Sunday paper. Thus, a newspaper company could sell special Sunday tokens which could be assigned a unit value equal to the value of a Sunday paper, such as 400 units. The apparatus 10 would recognize the token by its particular signature containing the learned peak frequency and peak amplitude values as described above.

In addition, two special tokens, each assigned different unit values, such as 510 and 511, for example, may also be employed. The token having a unit value of 510 may be used by a carrier to automatically set the daily total vend price of a newspaper. The other special token carrying a 511 unit value can be used to set the Sunday newspaper price. In this manner, after the characteristics of each special token have been learned, the carrier merely only inserts one of the tokens into the apparatus 10. The apparatus 10, upon recognizing the unique peak frequency and amplitude characteristics of the special token, will revise the total vend price of the newspapers or articles to the preset amount stored in the memory 162. The subsequent insertion of the other special token will revise the total vend amount accordingly. Preferably, the coin receptacle 44 is then immediately rotated to the coin return position to discharge the token to the coin return receptacle 16 for return to the carrier. The processor 160 then can release the latch pin as described above.

After all programming has been completed, the coin identification apparatus 10 is ready to receive coins, identify such coins as acceptable or non-acceptable, and dispense articles, such as newspapers, from the surrounding enclosure by allowing release of the door latch 70. As a first coin is inserted through the slots 14 and 98, the coin will trip lower end 116 of the coin detect arm 110 thereby generating an output signal from the sensor 122 due to movement of the magnet 114 on the coin detect arm 110 relative to the sensor 122. In response to this signal from the switch 122, the processor 160 turns on the transistor 168 thereby establishing a ground connection for the oscillator 176 and the sample and hold circuit 180. The coin then continues to pass through the coin passage 120 wherein it passes between the series connected coils 134 and 136 causing a disturbance or variation in the magnetic field between the coils 134 and 136. This variation causes a change in the frequency and amplitude of the output of the oscillator 176. The output of the oscillator 176 is constantly sampled by the sample and hold circuit 180 and output therefrom to the amplifier 182 and then to the processor 160. The processor 160 detects the maximum peak frequency and the minimum peak amplitude for each coin passing through the coils 134 and 136. These maximum peak frequency and minimum peak amplitude values are then compared with each of the frequency-amplitude value pairs stored in the memory 162.

In a normal coin receiving state, processor 160 has activated the motor 24 to rotate the shaft 38 to position the coin basket 44 directly underneath the discharge end of the coin passage 120. This enables each coin passing through the passage 120, after passing through the spaced coils 134 and 136, to be received within the coin basket 44.

Figure 10:
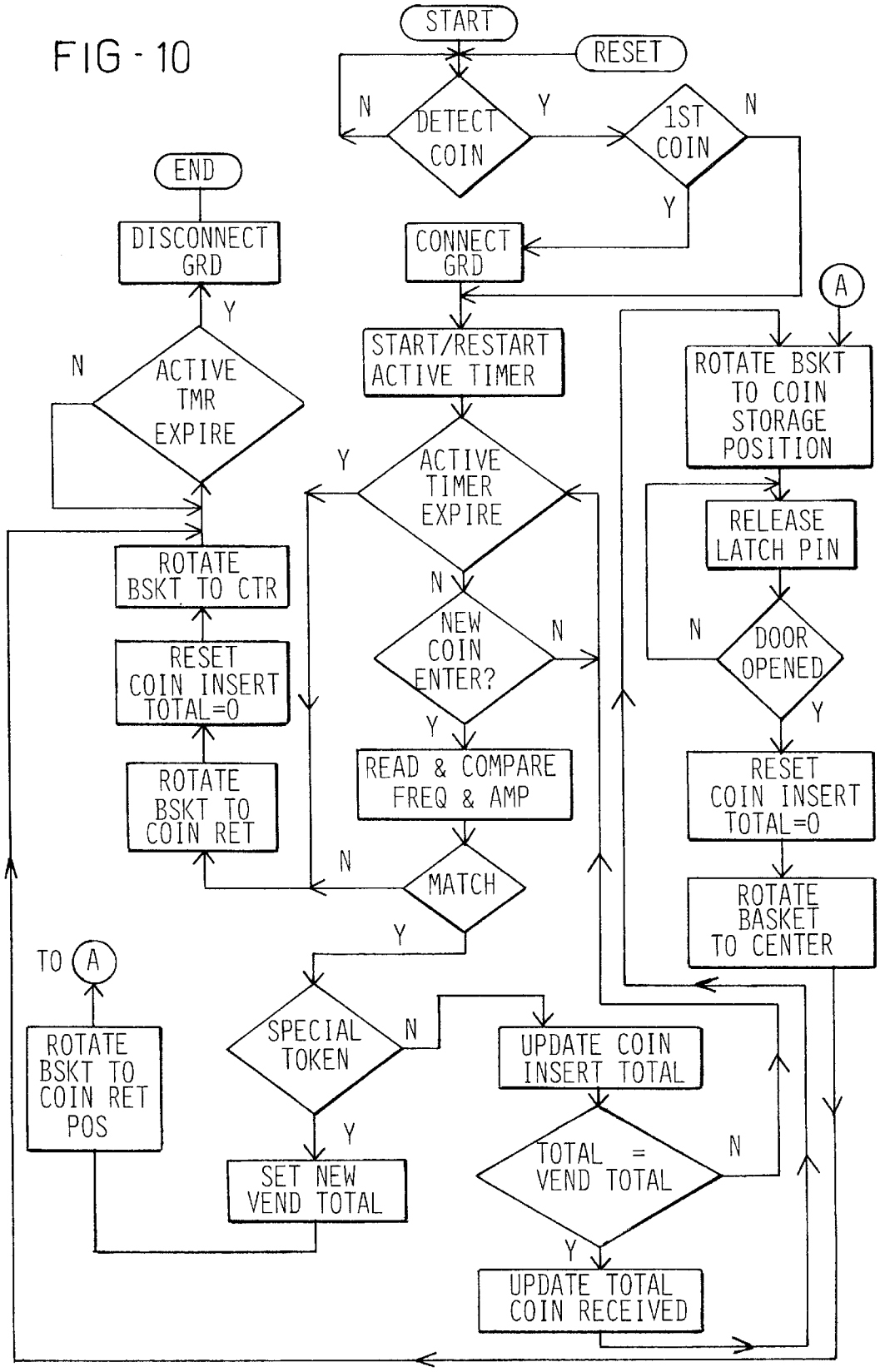
FIG. 10 is a flow diagram of the operation of the coin identification apparatus of the present invention.

As shown in FIG. 10, upon detecting the insertion of a first coin, the processor 160 connects the analog circuits 176 and 180 to ground.

Upon detecting the first and each subsequent inserted coin, the processor 160 starts or restarts an active timer having a short time period, such as 5–8 seconds, during which the processor 160 looks for the insertion of a subsequent coin. If a subsequent coin is not inserted through the slots 14 and 98 within the active time period, the processor 160 activates the motor 24 to rotate the coin basket 44 to the first position, thereby discharging all accumulated coins in the coin basket 44 into the coin return receptacle 16.

Assuming that a subsequent coin has been timely inserted into the coin identification apparatus 10, the processor 160 will compare the peak frequency and peak amplitude characteristics of the inserted coin with the stored characteristics of all valid coins to detect a match. If a match is detected, the processor 160 will add the unit value or total currency amounts of the coin to the total received coin value. When the total accumulated unit value or total currency value equals a preset amount programmed into the memory 162, which is indicative of the total cost of a vend article or newspaper, the processor 160 will perform several substantially simultaneous functions. First, the processor 160 will activate the drive motor 24 to rotate the coin basket 44 to the second position discharging all coins in the coin basket 44 into the coin deposit or storage portion of the coin identification apparatus 10. Secondly, simultaneously with rotation of the shaft 38 coupled to the coin basket 44, the cam 40 will also rotate in a direction bringing the flat 42 on the cam 40 into a position facing the spring 80. This enables the spring 80 to bend in a direction pulling the latch pin 76 out of engagement with the door latch 70. The spring 80 moves under its resilient spring force to pull the latch pin 70 out of the slot 66 in the door receiver 64. This enables the door latch 70 and the attached door to be displaced from a closed position thereby allowing access to the interior of the enclosure. The processor 160 also adds the total inserted coin units to the total of all coins previously received.

Upon detecting the door opening, the processor 160 zeros or resets the total coin inserted value register. After a set time period of approximately 2–5 seconds, the processor 160 reactivates the drive motor 24 to rotate the coin basket 44 back to the center, coin receiving position. This causes the larger diameter, circular portion of the cam 40 to bias the spring 80 to a position causing the latch pin 76 to slide back into the slot 66 in the door receiver 64. When the door is subsequently moved to the closed position, the forward end 72 of the door latch 70 will engage and cause the latch pin 76 to momentarily move in an upward direction to allow the forward end of the door latch 72 to pass into the slot 66 in the door receiver 64. The latch pin 76 slides downwardly under the biasing force of the spring 80 into engagement with the shoulder 74 to latch the door latch 70.

At any time during the sequence of coin insertion, if the processor 160 detects a non-valid coin, which may constitute a slug, an unacceptable coin of a different country, or even an unacceptable coin of the user country, the processor 160 activates the motor 24 to rotate the coin basket 44 to the first coin return position thereby discharging all accumulated coins, including previously accepted valid coins, into the coin return receptacle 16. The processor 160 then resets the coin identification circuitry for a new coin receiving sequence and rotates the coin basket 44 in the center position.

In summary, there has been disclosed a unique coin identification or recognition device particularly suited for use in newspaper vending machines. The device overcomes many problems encountered with previously devised coin identification apparatus used in newspaper vending machines insofar as providing a low force latch ensuring complete closure and latching of the enclosure door, highly accurate coin identification, the capability of validating many different coins from different countries, automatic setting total vend prices, such as for Sunday and daily papers, compensation for ambient temperature and on-board battery voltage levels, a unique modular design employing a fewer number of total parts and a significant reduction in moving parts for longer reliability and ease of repair or maintenance.

What is claimed is:

1. A method of operating a coin-operated apparatus to dispense an article, the method comprising the steps of:

storing a plurality of distinct total vend values indicative of a currency amount required for an apparatus to dispense an article;

providing a plurality of distinct tokens, each distinct token associated with one of the plurality of distinct total vend values;

providing each one of the plurality of tokens with a distinct, metallic signature characteristic;

storing the at least one detectable characteristic of each token;

detecting the at least one characteristic of one token deposited into the apparatus;

comparing the detected characteristic of the deposited token with the prestored characteristics of the plurality of tokens to determine a match with one of the prestored token characteristics; and changing the total vend value to the total vend value associated with the deposited token matching one of the prestored token characteristics.

2. The method of claim 1 wherein the step of detecting the insertion of the distinct token comprises the steps of detecting the at least one characteristic of the token deposited in the apparatus.

3. The method of claim 1 further comprising the step of returning the token deposited into the apparatus to the user.

4. The method of claim 3 further comprising the steps of:

providing the apparatus with a coin receiver having a coin passage with a coin entrance and a coin discharge outlet;

providing a coin receptacle disposed at the coin discharge outlet of the coin passage for receiving coins from the coin passage and movable between at least a coin return position and a coin storage position; and moving the coin receptacle to the coin return position upon receiving a token.

5. The method of claim 4 further comprising the steps of:

providing the apparatus with an openable closure controlling access to a closed interior of the apparatus wherein the articles to be dispensed are stored; and opening the closure allowing access to the interior of the enclosure upon detecting a distinct token inserted into the coin passage.

6. The method of claim 1 wherein a single token is associated with each distinct total vend value.

7. The method of claim 1 further comprising the step of:

providing the apparatus with an openable closure controlling access to a closed interior of the apparatus wherein the articles to be dispensed are stored; and opening the closure allowing access to the interior of the enclosure upon detecting a distinct token.

8. The method of claim 1 further comprising the step of returning the token deposited into the apparatus to the user.

9. The method of claim 8 further comprising the steps of:

providing the apparatus with a coin receiver having a coin passage with a coin entrance and a coin discharge outlet;

providing a coin receptacle disposed at the coin discharge outlet of the coin passage for receiving coins from the coin passage and movable between at least a coin return position and a coin storage position; and moving the coin receptacle to the coin return position upon receiving a token.

10. The method of claim 9 further comprising the steps of:

providing the apparatus with an openable closure controlling access to a closed interior of the apparatus wherein the articles to be dispensed are stored; and opening the closure allowing access to the interior of the enclosure upon detecting a distinct token inserted into the coin passage.

11. The method of claim 1 further comprising the steps of:

learning the at least one characteristic of each of the plurality of tokens; and storing the characteristic of each token.

* * * * *